US005351669A

United States Patent [19]

Herzog

[11] Patent Number: 5,351,669

[45] Date of Patent: Oct. 4, 1994

[54] VALVE DEVICE FOR EXHAUST GAS FEEDBACK IN AN INTERNAL COMBUSTION ENGINE

[75] Inventor: Rolf Herzog, Schelklingen-Hütten, Fed. Rep. of Germany

[73] Assignee: Metallwarenfabrik Schelklingen GmbH, Schelklingen, Fed. Rep. of Germany

[21] Appl. No.: 79,128

[22] Filed: Jun. 17, 1993

[30] Foreign Application Priority Data

Jan. 22, 1993 [DE] Fed. Rep. of Germany ..... 4301655

[51] Int. Cl.[5] ..... F02M 25/07

[52] U.S. Cl. ..... 123/568; 123/571

[58] Field of Search ..... 123/568, 569, 571; 137/907; 251/129.15

[56] References Cited

U.S. PATENT DOCUMENTS

| | | | |
|---|---|---|---|
| 3,834,363 | 9/1974 | Goto et al. | 123/568 |
| 3,981,283 | 9/1976 | Kaufman | 123/568 |
| 4,122,810 | 10/1978 | Berriman | 123/568 |
| 4,148,286 | 4/1979 | Kohana et al. | 123/568 |
| 4,180,034 | 12/1979 | Vogelsberg | 123/568 |
| 4,345,572 | 8/1982 | Suzuki et al. | 123/568 |
| 4,350,136 | 9/1982 | Yanagisawa | 123/568 |

*Primary Examiner*—Willis R. Wolfe

*Attorney, Agent, or Firm*—FLynn, Thiel, Boutell & Tanis

[57] ABSTRACT

The valve device for exhaust gas feedback in an internal combustion engine comprises a controlled valve (1) whose valve plate (1*a*) cooperates with a valve seat (2) in a valve housing (7*b*). The exhaust gas inlet of the valve housing is connected via an exhaust gas feedback pipe (7) to the exhaust gas side of the internal combustion engine and the exhaust gas outlet is connected through a connecting pipe (16) to the induction side of the internal combustion engine. The valve housing is formed by an end section (7*b*) of the exhaust gas feedback pipe (7) itself and the valve seat (2) is formed by a constriction (8) formed in the end section. The pipe part (9) of the end section (7*b*) connected to the constriction (8) carries the regulating actuator housing (3). The pipe part (9) is provided at the side with an opening (14) forming the exhaust gas outlet and the connecting pipe (16) is brazed to the pipe part (9) in the region of this opening (14).

6 Claims, 2 Drawing Sheets

VALVE DEVICE FOR EXHAUST GAS FEEDBACK IN AN INTERNAL COMBUSTION ENGINE

FIELD OF THE INVENTION

This invention relates to a valve device for exhaust gas feedback in an internal combustion engine, with a controlled valve whose valve plate cooperates with a valve seat, with a valve housing containing the valve seat and which has an exhaust gas inlet upstream, in the flow direction of the exhaust gases, of the valve seat and an exhaust gas outlet downstream of the valve seat, as well as a valve union receiving a regulating actuator housing, wherein the exhaust gas inlet is connected via an exhaust gas feedback pipe to the exhaust gas side of the internal combustion engine and the exhaust gas outlet is connected through a connecting pipe to the induction side of the internal combustion engine, and wherein the valve spindle of the valve connected to the regulating actuator extends through the valve union.

BACKGROUND OF THE INVENTION

In order to reduce the nitrous oxides ($NO_x$) in the exhaust gases of internal combustion engine it is known to feed back a proportion of the exhaust gas from the exhaust gas side of the internal combustion engine to the induction side of the same. The amount of exhaust gas fed back must however be regulated very accurately in dependence on several factors, such as for example the temperature of the engine (temperature of the coolant), the amount of induced air and the speed of rotation, in order to avoid poor running in the start-up phase and to ensure as high as possible a reduction of the nitrogen oxide proportions during operation. In order to regulate the amount of exhaust gas fed back a valve is provided between the exhaust gas feedback pipe coming from the exhaust manifold and the connecting pipe leading to the induction side of the engine, this valve being controlled by an regulating actuator, e.g. a vacuum-sensitive diaphragm. In order to optimise the amount of exhaust gas fed back an electronic regulator is used, which controls the vacuum acting on the diaphragm in dependence on the aforesaid different parameters and thus controls the valve position of the valve. Such an electronic control (Pressure Drop Feedback Electronics δPFE) comprises a programmed electronic control module, to whose inputs are applied the speed of rotation, coolant temperature and the air throughput. The control module sends a signal to a vacuum regulator which controls the vacuum acting on the diaphragm. The diaphragm opens the valve of the valve device in accordance with the vacuum pressure. A control throttle orifice is provided in the exhaust gas feedback pipe. A transducer compares the pressure obtaining before and after the throttle orifice and sends a feedback signal to the control module. Any deviation in this again effects control of the valve by means of the vacuum regulator and the diaphragm.

In the initially mentioned known valve device a housing consisting of a die casting is provided, having relatively large dimensions and a correspondingly high weight. In order to ensure satisfactory performance of the valve, the valve seat is formed as a separate turned part and is fitted into the cast housing. The exhaust gas feedback pipe is provided with a backnut and a beading retaining the same. The back nut is screwed into a thread on the exhaust gas inlet of the cast housing. The cast housing has a flange on the exhaust gas outlet side, to which the connecting pipe provided with a complementary flange is fixed. The diaphragm housing is fixed to the cast housing by three screws. The manufacture of the cast housing is however relatively expensive, since the valve seat is separately made and has to be fitted into the cast housing. Moreover the thread on the exhaust gas inlet and the flange on the exhaust gas outlet have to be machined. In addition it is necessary to provide the exhaust gas feedback pipe with a back nut and the beading and to provide the connecting pipe with a complementary flange. The cast housing is also relatively large and heavy. On account of the large mass stable brackets, which are thus also expensive to manufacture and heavy, are needed to fix it. Since the angular position of an inlet bend provided on the cast housing is fixed relative to the flange provided on the exhaust gas outlet and cannot be altered, different cast housings are mostly required for different engine types, which additionally increases the manufacturing costs. In all the assembly costs are relatively large, since the valve seat must be pressed into the cast housing and the screwing of the exhaust gas feedback pipe and connecting pipe to the cast housing require a corresponding expenditure of time.

SUMMARY OF THE INVENTION

The invention is therefore based on the object of providing a valve device of the kind initially referred to for an exhaust gas feedback in an internal combustion engine, which is simpler to make, has a smaller weight and smaller dimensions and also requires smaller expenditure in assembly.

This is achieved according to the invention in that the valve housing is formed by an end section of the exhaust gas feedback pipe itself, in that the valve seat is formed by a constriction in the end section formed without machining, in that the valve union is formed by a pipe part of the end section connected to the constriction, in that this pipe part is provided at the side with an opening forming the exhaust gas outlet and in that the connecting pipe or a section of the same is brazed to the pipe part in the region of this opening.

The manufacture and the trouble of assembly are essentially reduced in that the valve housing is formed by an end section of the exhaust gas feedback pipe itself and the cast housing is thus obviated. The forming to be carried out on the end section of the exhaust gas feedback pipe can largely be effected without machining and be effected with the machines and devices which are needed in any event for the manufacture of the exhaust gas feedback pipe. Since the valve seat is formed by a constriction of the exhaust gas feedback pipe itself, separate manufacture and assembly of the valve seat are avoided. Moreover the expense of assembly which is otherwise required in connecting the cast housing to the exhaust gas feedback pipe is avoided, since the exhaust gas feedback pipe at the same time forms the valve housing. The connection of the connecting pipe or a part of the same to the pipe part of the exhaust gas feedback pipe also only requires small assembly costs, since all that is needed for this it to braze the connecting pipe or a part thereof to the exhaust gas feedback pipe. Since further brazing steps are normally needed on the exhaust gas feedback pipe, the brazing of the connecting pipe can be carried out in one working step with the other brazing steps. However the small dimensions and above all the small weight, which the end section of the exhaust gas feedback pipe forming the valve housing have, operate to special advantage over a valve housing formed as a casting. As a result of the small weight and small mass the vibrational conditions are substantially better and easily controlled. The bracket required for attachment to the engine can be made substantially simpler and lighter. By brazing the connecting pipe or a part thereof to the pipe part of the exhaust gas feedback pipe by brazing the troublesome flange coupling is obviated and if desired standard screw couplings can be used to couple a section of the connecting pipe to a further section thereof. Furthermore the novel valve device can easily be adapted to the different engine types, since the angular position of the exhaust gas feedback pipe relative to the connecting pipe or a section of the same can easily be altered by suitably shaping the pipe bends of the exhaust gas feedback pipe. Furthermore it is also possible, if necessary, by using exhaust gas feedback pipes of different diameters to match the whole valve device to the powers of the respective engines.

BRIEF DESCRIPTION OF THE DRAWINGS

The invention is explained in more detail below, with reference to the embodiments shown in the drawings. In the drawings.

DETAILED DESCRIPTION

Figure 1:
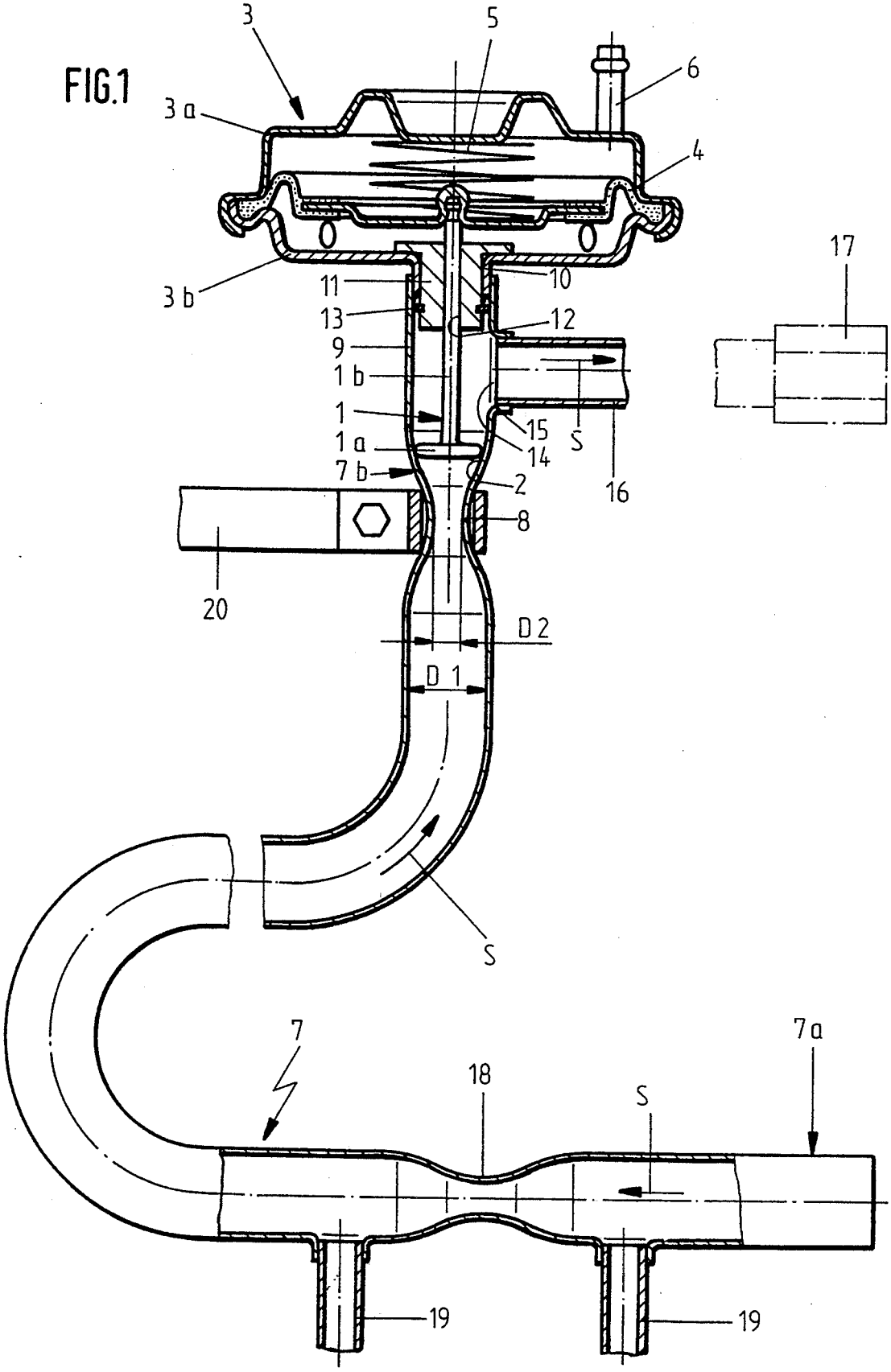
FIG. 1 is a longitudinal section of a first embodiment of the valve device.

The valve device shown in FIG. 1 comprises a controlled valve 1, whose valve plate 1*a* cooperates with a valve seat 2 and whose valve spindle 1*b* is connected to a diaphragm 4 arranged in the regulating actuator housing 3. The diaphragm 4 is biased in the direction for closing the valve 1 by the restoring spring 5. A vacuum connection 6 is provided in the upper part 3*a* of the regulating actuator housing 3 and is connected through an electronically controlled pressure regulator to a vacuum source which is normally provided by the air inlet chamber of the internal combustion engine.

The exhaust gas feedback pipe 7 is connected at one end 7*a* to the exhaust gas side of the internal combustion engine (not shown), e.g. to the exhaust manifold. The other end section 7*b* of the exhaust gas feedback pipe 7 forms the valve housing for the valve 1. By means for effecting a shaping without machining, especially by a so-called beating or swaging process, of the exhaust gas feedback, a constriction 8 is formed in a portion of the end section 7*b*. Through this constriction 8 the inner diameter D1 of the exhaust gas feedback pipe 7, which amounts for example with an outer diameter of 16 mm and a wall thickness of 0.8 mm to 13.4 mm, is reduced to a smallest diameter D2 of approximately 5 to 6 mm in the region of the constriction 8. The valve seat 2 for the valve plate 1*a* is formed by the part of the constriction 8 lying above this reduction. The direction of flow of the exhaust gases is shown by the arrows S. The pipe part 9 of the end section 7*b* connected on to the constriction 8 in the direction of flow forms a valve union through which the valve spindle 1*b* extends. The pipe part 9 also serves as the support for the regulating actuator housing 3. The lower part 3*b* of this is provided with a shaped-on union 10, which is stuck into the pipe part 9 and is preferably brazed to the pipe part. In this manner a firm connection between the exhaust gas feedback pipe 7 and the regulating actuator housing is created with a relatively small cost of manufacture and assembly. If desired however, the regulating actuator housing 3 could equally be connected removably to the pipe part 9, for example by a screw thread, but this would entail increased costs of manufacture and assembly.

A guide body 11 of bronze for example is fitted in the union 10 and has a guide bore 12 for the valve spindle 1*b*. The guide body 11 has a peripheral groove in which is fitted a spring ring 13, e.g. a round wire spring ring according to DIN 7993. The guide body 11 is secured against axial displacement in the union 10 by this spring ring 13.

The pipe part 9 is provided at the side with an opening 14 above the valve 1 and below the union 10, forming an exhaust gas outlet. The opening is advantageously surrounded by a collar 15 deformed out of the wall of the pipe part. The formation of the collar 15 can advantageously be effected conventionally by a so-called "necking out method", in which a bore is first made in the wall of the pipe by a suitable tool and the collar 15 is formed by the withdrawal of the tool. A larger brazing surface is provided by the collar 15. The connecting pipe 16, which serves to feed back the exhaust gases to the induction side of the internal combustion engine, for example to the air inlet chamber, not shown, is connected to the opening 14. The connecting pipe 16 is stuck into the collar 15 for this purpose and is brazed there. Instead of the complete connecting pipe only a section of the same could be brazed to the collar 15, this section then having the standard pipe threading shown in broken lines for connection to the rest of the connecting pipe.

For the sake of completeness it should be mentioned that the exhaust gas feedback pipe 7 can have a further constriction 18 in known manner in a region preceding the constriction 8. This constriction 18 forms a Venturi nozzle for the pressure measurement. To measure the pressure obtaining in the exhaust gas feedback pipe measuring unions 19 are brazed in similar manner to the connecting pipe 16 before and after the constriction 18. The measuring unions 19 are sized to the initially mentioned transducer, which measures the pressure difference and feeds suitable feedback signals to the control module likewise initially mentioned. The actual exhaust gas throughflow in the exhaust gas feedback pipe can be measured by means of the pressure difference.

The exhaust gas feedback pipe 7 and also the measuring unions 19 usually consist of stainless steel. The measuring unions 19 are usually brazed under vacuum. The brazing of the connection pipe 16 or a section thereof into the collar 15, as well as the brazing of the union 10 into the pipe part 9 can be effected at the same time as the brazing of the measuring unions 19 and thus does not require any substantial additional manufacturing expense. In comparison with the conventional method of connection by screwing however, brazing has the substantial advantage that the assembly expense is reduced and that a rigid connection is made which cannot come loose with vibration.

Since the valve housing is formed in accordance with the invention by an end section 7*b* of the exhaust gas feedback pipe 7, the valve housing has a relatively small mass compared with a conventional cast housing. Since moreover the valve housing forms a unit with the exhaust gas feedback pipe 7 and this is connected in any event at various points to the internal combustion engine, only a simple and light bracket 20 is needed in the region of the valve, being for example in the form of a pipe clip engaging in the region of the constriction 8 in the end section 7*b*.

By means of the electronic control of the vacuum pressure existing in the upper part 3*a* as already described at the outset, the diaphragm 4 is affected to a greater or lesser extent by vacuum and thus raises the valve plate 1*a* to a greater or lesser extent from the valve seat 2. The amount of exhaust gas drawn off from the exhaust side of the internal combustion engine and fed back to the induction side of the engine through the connecting pipe 16 is regulated by the current valve position.

Figure 2:
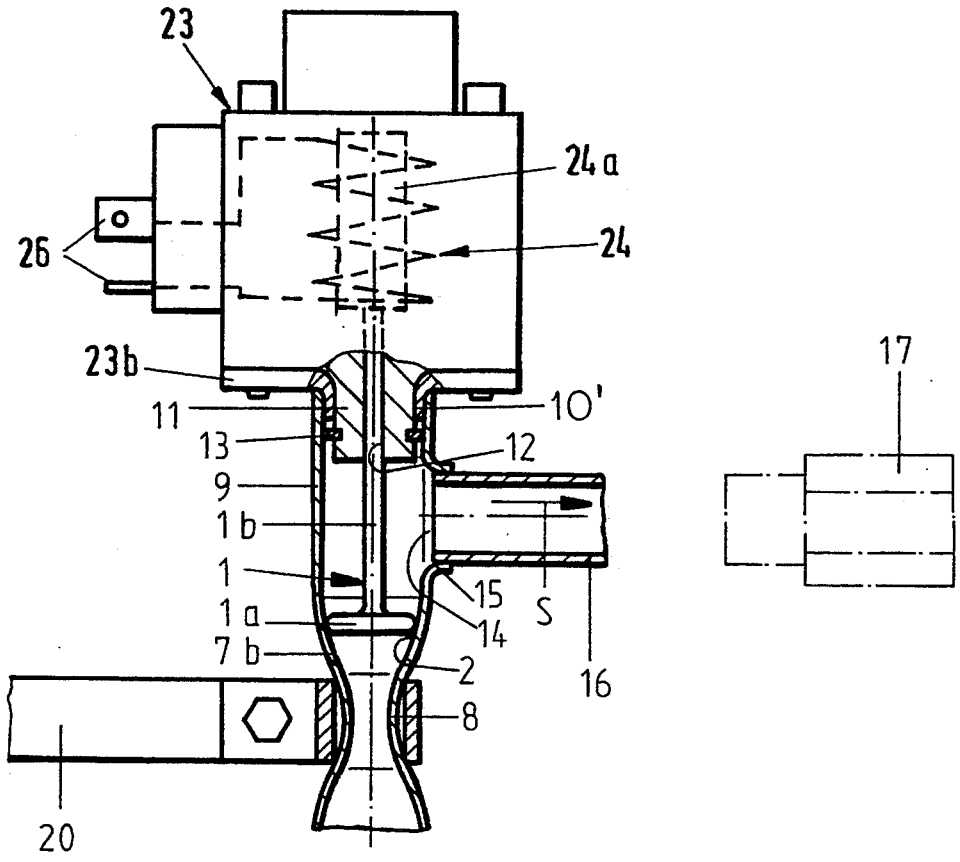
FIG. 2 is a second embodiment in longitudinal section.

The control of the valve 1 can be effected by any arbitrary position actuator, for example also electric or electronic. In the embodiment shown in FIG. 2, an electromagnet 24 is arranged in the regulating actuator housing 23, its armature 24*a* being connected to the valve spindle 1*b* and its magnet coil 24*b* being supplied with control current through the current terminals 26. The lower part 23*b* of the regulating actuator housing 23 is provided with a formed union 10' which is stuck into the pipe part 9. The valve plate 1*a* is raised to a greater or lesser degree from the valve seat 2 by the electromagnet 24 and the valve spindle 1*b*. The other parts of the valve device correspond with the parts of the valve device shown in FIG. 1 and have therefore been given the same reference numerals. The previous description applies equally to the embodiment shown in FIG. 2.

I claim:

1. In a valve arrangement for an exhaust-gas return in an internal combustion engine, comprising a control valve having reciprocally movable valve plate attached to a valve spindle, a valve housing containing a valve seat against which the valve plate is sealingly moved, said valve housing having, in a direction of flow of exhaust gases from the internal combustion engine upstream of the valve seat, an exhaust gas inlet connected to an exhaust gas return pipe and, downstream of the valve seat, an exhaust gas outlet and a valve connection supporting a housing having therein an adjustable drive mechanism, wherein the exhaust gas return pipe is connected to the exhaust gas side of the internal combustion engine and wherein the exhaust gas outlet is connected to and through a connecting pipe to a suction side of the internal combustion engine, and wherein the valve spindle extends through the valve connection, the improvement wherein the valve housing is formed from an end section of the exhaust gas return pipe itself, wherein the valve seat is defined by a constriction formed in the end section by means of a chipless deformation, wherein the valve connection is defined by an extension of the pipe of the end section located downstream of the constriction and terminating in an open pipe end, wherein the valve connection includes a means for securing the valve housing to the extension of the pipe and in the open end, wherein said extension of pipe includes a region defining a lateral opening defining the exhaust gas outlet, and wherein the connecting pipe is brazed to the extension of pipe and the region defining the lateral opening.

2. The valve device according to claim 1, wherein the opening is surrounded by a collar deformed out of the wall of the pipe part, an end portion of the connection pipe being received and brazed in the opening.

3. The valve device according to claim 1, wherein the constriction is formed by beating the pipe wall of the exhaust gas feedback pipe.

4. The valve device according to claim 1, wherein the smallest inner diameter of the constriction is approximately one-half to a third of the size of the inner diameter of the exhaust gas feedback pipe.

5. The valve device according to claim 1, wherein said means for securing the valve housing to the extension of the pipe comprises an under part of the valve housing being provided with an integral shaped union and wherein the union is received into and brazed to the open end of the extension of the pipe.

6. The valve device according to claim 5, wherein said means for securing the valve housing to the extension of the pipe further includes a guide body fitted in the union, said guide body having an opening extending therethrough for guiding the valve spindle, said guide body having a spring ring thereon for blocking relative movement between said guide body and said union.

* * * * *

UNITED STATES PATENT AND TRADEMARK OFFICE

CERTIFICATE OF CORRECTION

PATENT NO. : 5 351 669

DATED : October 4, 1994

INVENTOR(S) : Rolf HERZOG

It is certified that error appears in the above-indentified patent and that said Letters Patent is hereby corrected as shown below:

Column 6, line 13; change "valve housing" to
---housing of the adjustable drive mechanism---.

Column 6, line 31; change "valve housing" to
---housing of the adjustable drive mechanism---.

Column 6, line 37; change "valve housing" to
---housing of the adjustable drive mechanism---.

Signed and Sealed this

Thirtieth Day of January, 1996

*Attest:*

*Attesting Officer*

BRUCE LEHMAN

*Commissioner of Patents and Trademarks*